US010569552B2

(12) United States Patent
Nagao

(10) Patent No.: US 10,569,552 B2
(45) Date of Patent: Feb. 25, 2020

(54) PRINTER, PRINTING METHOD, AND STORAGE MEDIUM

(71) Applicant: CASIO COMPUTER CO., LTD., Shibuya-ku, Tokyo (JP)

(72) Inventor: Tomoyuki Nagao, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/241,921

(22) Filed: Jan. 7, 2019

(65) Prior Publication Data

US 2019/0210370 A1 Jul. 11, 2019

(30) Foreign Application Priority Data

Jan. 9, 2018 (JP) ..... 2018-000941

(51) Int. Cl.

| | |
|---|---|
| ***B41J 11/00*** | (2006.01) |
| ***A45D 29/00*** | (2006.01) |
| ***B41J 2/165*** | (2006.01) |
| ***B41J 3/407*** | (2006.01) |
| ***A45D 44/00*** | (2006.01) |

(52) U.S. Cl.

CPC ..... *B41J 2/16511* (2013.01); *A45D 29/00* (2013.01); *A45D 29/004* (2013.01); *A45D 44/005* (2013.01); *B41J 2/16508* (2013.01); *B41J 2/16526* (2013.01); *B41J 2/16538* (2013.01); *B41J 2/16544* (2013.01); *B41J 2/16588* (2013.01); *B41J 3/4073* (2013.01); *B41J 11/008* (2013.01); *A45D 2029/005* (2013.01)

(58) Field of Classification Search

CPC ..... B41J 2/16511; B41J 2/16544; B41J 2/16588; B41J 11/008; B41J 3/4073; A45D 29/00; A45D 29/004; A45D 44/005; A45D 2029/005

See application file for complete search history.

(56) References Cited

U.S. PATENT DOCUMENTS

| | | | | |
|---|---|---|---|---|
| 9,399,343 | B2 | 7/2016 | Kuroda | |
| 10,130,154 | B2 * | 11/2018 | Irie | A45D 29/00 |
| 2011/0175966 | A1 | 7/2011 | Kuroda | |

(Continued)

FOREIGN PATENT DOCUMENTS

| | | | |
|---|---|---|---|
| JP | 2001179949 | A | 7/2001 |
| JP | 3085839 | U | 5/2002 |

(Continued)

*Primary Examiner* — Anh T Vo

(74) *Attorney, Agent, or Firm* — Holtz, Holtz & Volek PC

(57) ABSTRACT

A printer includes a print head and a processor. The processor controls operation of the head. In an area where the head is movable, (i) a drawing region where a finger or a toe is placed, and the head performs drawing on a nail of the finger or the toe, (ii) a standby region where the head is positioned during a no-drawing period, and (iii) a suspension region where the head can stop temporarily are provided such that a moving distance of the head from the suspension region to the drawing region is shorter than a moving distance of the head from the standby region to the drawing region. If nails are successively subjected to the drawing, the processor causes the head to stop temporarily in the suspension region between drawing operations on the nails without causing the head to move to the standby region.

8 Claims, 7 Drawing Sheets

(56) References Cited

U.S. PATENT DOCUMENTS

| | | | | |
|---|---|---|---|---|
| 2015/0128981 | A1* | 5/2015 | Asako | A45D 29/00<br>132/200 |
| 2015/0174914 | A1* | 6/2015 | Bitoh | A45D 29/00<br>347/6 |

FOREIGN PATENT DOCUMENTS

| | | | |
|---|---|---|---|
| JP | 2003334961 | A | 11/2003 |
| JP | 2011143602 | A | 7/2011 |

* cited by examiner

PRINTER, PRINTING METHOD, AND STORAGE MEDIUM

CROSS-REFERENCE TO RELATED APPLICATIONS

This application is based upon and claims the benefit of priority under 35 U.S.C. 119 of Japanese Patent Application No. 2018-000941 filed on Jan. 9, 2018 the entire disclosure of which, including the description, claims, drawings, and abstract, is incorporated herein by reference in its entirety.

BACKGROUND OF THE INVENTION

1. Field of the Invention

The present invention relates to a printer, a printing method, and a storage medium.

2. Description of the Related Art

There is known an inkjet drawing apparatus (inkjet printer) which makes ink into fine droplets and ejects the fine droplets from an ink ejection surface of a drawing head (print head), thereby performing drawing on a drawing target.

In the inkjet drawing apparatus, in general, during a no-drawing period in which no drawing is performed, the drawing head stands by at a predetermined home position, and the ink ejection surface is covered with and protected by a cap or the like. (Refer to, for example, JP 2011-143602 A.)

SUMMARY OF THE INVENTION

A plurality of objects of the present invention includes providing a printer, a printing method and a storage medium storing a program which can make drawing time shorter than ever before in a case where drawing targets are separately and successively subjected to drawing in a drawing region.

According to an embodiment of the present invention, there is provided a printer including: a print head; and a processor which controls operation of the print head, wherein in an area where the print head is movable, (i) a drawing region where a finger or a toe is placed, and the print head performs drawing on a nail of the finger or the toe, (ii) a standby region where the print head is positioned during a no-drawing period in which the print head does not perform the drawing, and (iii) a suspension region where the print head can stop temporarily are provided such that a moving distance of the print head from the suspension region to the drawing region is shorter than a moving distance of the print head from the standby region to the drawing region, and if one nail is subjected to the drawing, and successively a next nail is subjected to the drawing, the one nail and the next nail being included in the nail being two or more nails, the processor causes the print head to stop temporarily in the suspension region between drawing operations on the one nail and the next nail without causing the print head to move to the standby region.

According to another embodiment of the present invention, there is provided a printing method for a printer including a print head, wherein in an area where the print head is movable, (i) a drawing region where a finger or a toe is placed, and the print head performs drawing on a nail of the finger or the toe, (ii) a standby region where the print head is positioned during a no-drawing period in which the print head does not perform the drawing, and (iii) a suspension region where the print head can stop temporarily are provided such that a moving distance of the print head from the suspension region to the drawing region is shorter than a moving distance of the print head from the standby region to the drawing region, the printing method including: if one nail is subjected to the drawing, and successively a next nail is subjected to the drawing, the one nail and the next nail being included in the nail being two or more nails, causing the print head to stop temporarily in the suspension region between drawing operations on the one nail and the next nail without causing the print head to move to the standby region.

According to another embodiment of the present invention, there is provided a non-transitory computer readable storage medium storing a program that is executed by a computer which controls a printer including a print head, wherein in an area where the print head is movable, (i) a drawing region where a finger or a toe is placed, and the print head performs drawing on a nail of the finger or the toe, (ii) a standby region where the print head is provided during a no-drawing period in which the print head does not perform the drawing, and (iii) a suspension region where the print head can stop temporarily are provided such that a moving distance of the print head from the suspension region to the drawing region is shorter than a moving distance of the print head from the standby region to the drawing region, the program causing the computer to: if one nail is subjected to the drawing, and successively a next nail is subjected to the drawing, the one nail and the next nail being included in the nail being two or more nails, cause the print head to stop temporarily in the suspension region between drawing operations on the one nail and the next nail without causing the print head to move to the standby region.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention, wherein.

DETAILED DESCRIPTION OF THE INVENTION

Figure 1:
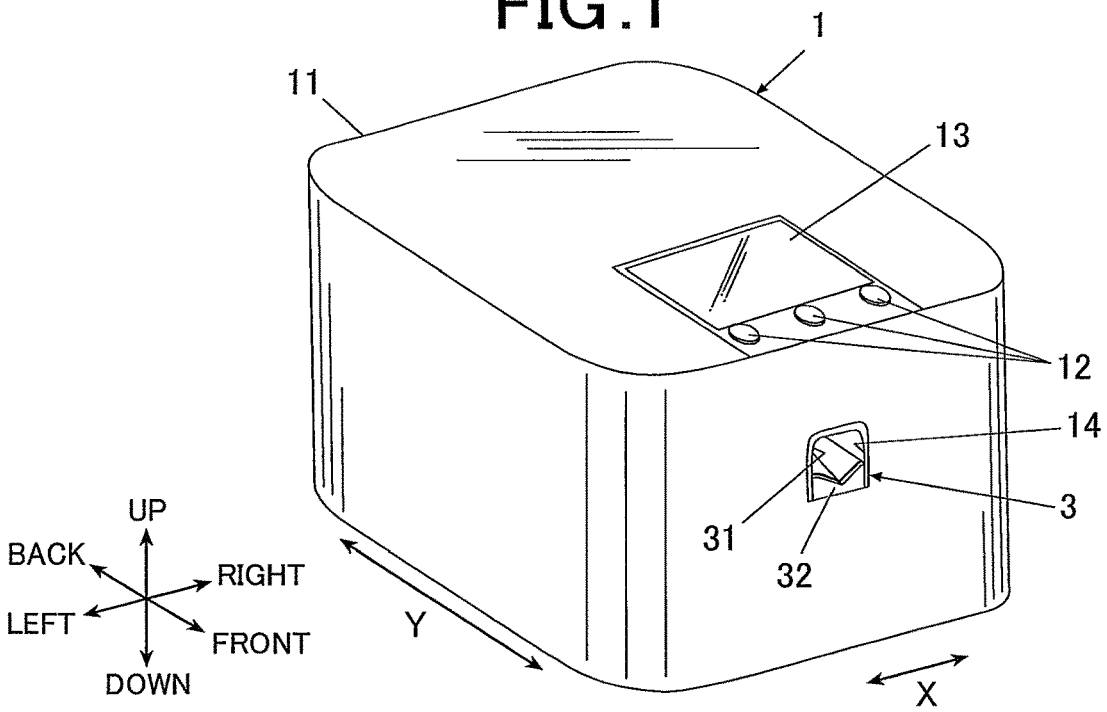
FIG. 1 is a perspective view showing external appearance/configuration of a nail printer according to an embodiment(s)

An embodiment(s) of a printer (drawing apparatus) of the present invention will be described with reference to FIG. 1 to FIG. 10.

The embodiment described below is provided with various limitations technically preferable for carrying out the present invention. However, the scope of the present invention is not limited to the embodiment below or illustrated examples.

Further, in the embodiment below, a nail printer which performs drawing on nails of fingers as drawing target(s) is described as an example of the printer. However, the drawing target of the printer of the present invention is not limited to nails of fingers. For example, nails of toes may be the drawing target. Other than nails, nail tips and surfaces of various accessories may also be the drawing target.

First, configuration of a nail printer 1 of this embodiment will be described.

FIG. 1 is a perspective view showing external appearance/configuration of the nail printer 1.

As shown in FIG. 1, the nail printer 1 of this embodiment has a case 11 which is formed to be approximately box-shaped.

On the upper surface (top) of the case 11, an operation unit 12 is installed.

The operation unit 12 is an input unit for a user(s) to make various inputs.

On the operation unit 12, operation buttons to make various inputs are arranged. Examples of the operation buttons include a power button to turn on the power of the nail printer 1, a stop button to stop operation of the nail printer 1, a design selection button to select a design image to be drawn on a nail(s) T (shown in FIG. 8A, FIG. 8B, etc.), and a drawing start button to make an instruction to start drawing.

On the upper surface (top) of the case 11, a display 13 is also installed.

The display 13 is constituted of, for example, a liquid crystal display (LCD), an organic electroluminescence display, or another flat display.

In this embodiment, the display 13 displays, as needed, a nail image (finger image including an image of a nail T) obtained by imaging a finger, an image of the contour line of the nail T included in the nail image, an image of a state in which an original image being a design image before being fitted to the shape of the nail T is projected to the nail T, a design selection screen to select a design image to be drawn on the nail T, a thumbnail image for design check, an instruction screen which displays various instructions, and so forth.

A touchscreen to make various inputs may be integrated with the surface of the display 13. In this case, the touchscreen functions as the operation unit 12.

On the internal (or lower) side of the upper surface (top) of the case 11, above a window part 33 of a finger holder 3 described below, an imaging mechanism 50 (shown in FIG. 6) described below is arranged. The imaging mechanism 50 images the nail T exposed from the window part 33, thereby obtaining the nail image (image of the finger including the nail T).

Specific arrangement of the imaging mechanism 50 is not particularly limited as long as the imaging mechanism 50 can image the nail T arranged in the finger holder 3. For example, instead of the internal side of the case 11, the imaging mechanism 50 may be fixed to any structure arranged in the case 11, or may be fixed to a carriage or the like of a drawing mechanism 40 described below and be moved by a head moving mechanism 49 (shown in FIG. 6) or the like.

In the front surface of the case 11, approximately at the center in the right-left direction, an opening part 14 is formed. The opening part 14 is where the finger corresponding to the nail T as the drawing target is inserted.

In the opening part 14, as described below, the finger holder 3 is arranged. The finger holder 3 holds and fixes the nail T (finger including the nail T).

Figure 2:
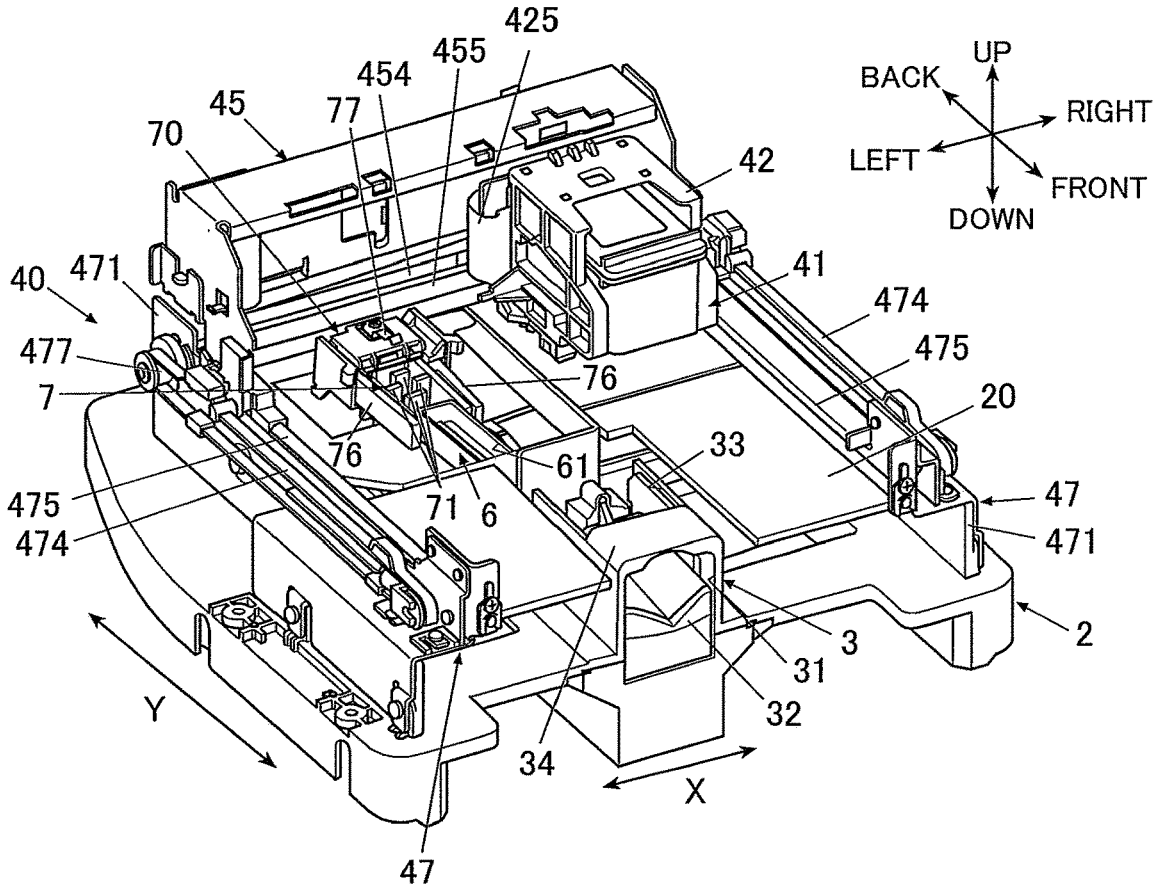
FIG. 2 is a perspective view schematically showing internal configuration of the nail printer according to the embodiment.

FIG. 2 is a perspective view schematically showing internal configuration of the nail printer 1 by removing the case 11 from the nail printer 1 shown in FIG. 1.

As shown in FIG. 2, in the case 11, abase 2 on which various internal structures (components) are mounted is arranged.

The upper surface of the base 2 is a base upper surface 20 which is approximately flat.

On the front portion of the base upper surface 20, approximately at the center in the right-left direction, the finger holder 3 is arranged at a position corresponding to the opening part 14 of the case 11.

The finger holder 3 is a box-shaped member having an opening part 31 in the front surface. In the finger holder 3, a finger holding member 32 which holds and fixes the finger is arranged.

The finger holding member 32 pushes and supports the finger from underneath, and is formed of, for example, flexible resin. In this embodiment, the finger holding member 32 is shaped to be concave approximately at the center in the width direction (right-left direction), and receives the ball of the finger when the finger is placed on the finger holding member 32, thereby preventing the finger from being unsteady in the right-left direction.

The back (or deep) portion of the upper surface of the finger holder 3 is opened and forms the window part 33. From the window part 33, the nail T of the finger inserted into the finger holder 3 is exposed.

In this embodiment, the region where the window part 33 is arranged is a drawing region 21 (shown in FIG. 3) where the drawing mechanism 40 described below performs drawing.

Figure 3:
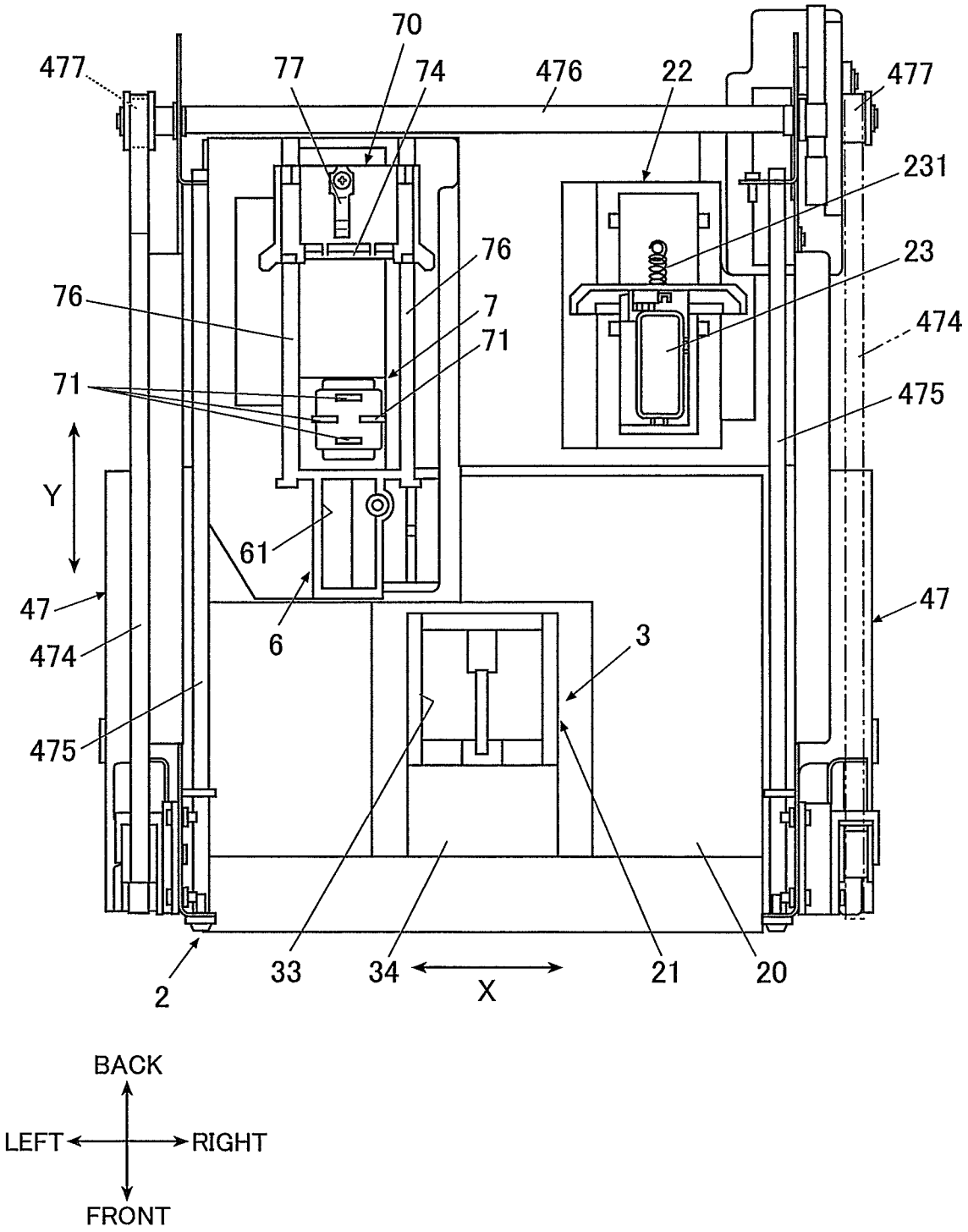
FIG. 3 is a plan view showing configuration of a base of the nail printer according to the embodiment.

The position of the window part 33 (i.e., the position of the drawing region 21) in the finger holder 3 is not limited to that shown in FIG. 3, etc. However, the drawing region 21 is provided, on the base upper surface 20, in an area where a drawing head 41 (print head) can be moved by the head moving mechanism 49 (shown in FIG. 6) described below.

The front portion of the upper surface of the finger holder 3 forms a finger push part 34 which prevents the finger from floating (rising) and limits the position of the finger in the up direction. The finger and its nail T are supported by the finger holding member 32 from underneath and pushed by the finger push part 34 from above, so that the finger is positioned at a predetermined position in the height direction.

As shown in FIG. 2, in the case 11, the drawing mechanism 40 which performs drawing on a drawing target surface is arranged. The drawing target surface is the surface of the drawing target, which is, in this embodiment, the surface of the nail T of the finger.

The drawing mechanism 40 includes: the drawing head 41 as the body of the drawing mechanism 40; a head carriage 42 which supports the drawing head 41; an X-direction movement stage 45 which moves the drawing head 41 in X direction which is along the right-left direction; an X-direction movement motor 46 (shown in FIG. 6); a Y-direction movement stage 47 which moves the drawing head 41 in Y direction which is along the front-back direction; a Y-direction movement motor 48 (shown in FIG. 6); and so forth.

The Y-direction movement stage 47 has supporting members 471 arranged at both sides of the base upper surface 20 in the right-left direction. The supporting members 471 extend in the front-back direction.

To both ends in the extending direction of each of the supporting members 471, which form a pair, pulleys 477 are attached. Around the pulleys 477 on the right of the nail printer 1 and around the pulleys 477 on the left thereof, respective drive belts 474 extending in the front-back direction are wounded.

The pulleys 477 at the back ends of the nail printer 1 are attached to both ends of a drive shaft 476 (shown in FIG. 3). To the drive shaft 476, the Y-direction movement motor 48 (shown in FIG. 6) is connected. When the Y-direction movement motor 48 operates, the drive shaft 476 and the pulleys 477 attached thereto rotate in the normal/opposite rotation direction appropriately.

Rotation of the pulleys 477 rotates the drive belts 474 wounded around the pulleys 477, so that the X-direction movement stage 45 (and the drawing head 41 mounted on the X-direction movement stage 45) can move in the Y direction.

On the supporting members 471, guide shafts 475 extending in the Y direction are arranged parallel to the drive belts 474.

The X-direction movement stage 45 is formed in the shape of a rectangular box extending in the right-left direction, and arranged at the back end of the base upper surface 20.

Into the right and left ends of the X-direction movement stage 45, the guide shafts 475 are inserted, respectively. When the Y-direction movement motor 48 operates, the drive belts 474 rotate, so that the X-direction movement stage 45 can move in the Y direction along the guide shafts 475.

In the X-direction movement stage 45, not-shown pulleys to which the X-direction movement motor 46 is connected are arranged. Around the pulleys, a drive belt 454 extending in the right-left direction is wounded. In the X-direction movement stage 45, a guide shaft 455 extending in the right-left direction is arranged approximately parallel to the drive belt 454.

To the X-direction movement stage 45, the head carriage 42 which supports the drawing head 41 is attached.

On the back surface of the head carriage 42, a not-shown carriage supporting member into which the guide shaft 455 is inserted is arranged.

Thus the guide shaft 455 is inserted into the head carriage 42. When the X-direction movement motor 46 operates, the drive belt 454 rotates, so that the head carriage 42 can move in the X direction along the guide shaft 455 in the X-direction movement stage 45.

In this embodiment, the X-direction movement motor 46, the Y-direction movement motor 48 and so forth constitute the head moving mechanism 49 (shown in FIG. 6) which can move the drawing head 41 in the X direction and the Y direction. Operation of the head moving mechanism 49 is controlled by a control device 80 (drawing controller 814, in particular) described below.

It is unnecessary that the drawing controller 814 which controls operation of the drawing head 41 and operation of the head moving mechanism 49 is fully arranged on one control board. For example, a processor 81 which controls ink ejection of the drawing head 41, operation of the X-direction movement motor 46 and so forth may be provided, and a not-shown control board electrically connected with the main control board may be arranged on the X-direction movement stage 45. In this embodiment, on the back surface of the head carriage 42, a flexible printed circuit board 425 is arranged. This printed circuit board 425 is electrically connected with the control board arranged on the X-direction movement stage 45. Control signals from the drawing controller 814 arranged on the main control board are sent to the printed circuit board 425 via the control board arranged on the X-direction movement stage 45, so that ink ejection of the drawing head 41 and so forth are performed under the control of the drawing controller 814.

The drawing head 41 of this embodiment is an inkjet head which performs drawing by an inkjet method.

The drawing head 41 is an ink-cartridge-integrated head in which not-shown ink cartridges of inks for yellow (Y), magenta (M) and cyan (C) are integrated with an ink ejection surface 411 (shown in FIG. 4) arranged on, of the respective ink cartridges, surfaces (lower surfaces, in this embodiment) facing the drawing target (surface of the nail T). In the ink ejection surface 411, ejection ports (ink ejection ports (not shown)) of nozzle arrays are formed in row(s). Each nozzle array is constituted of a plurality of nozzles from which an ink of a color is ejected. The drawing head 41 makes the inks into fine droplets, and performs drawing by ejecting the ink droplets directly to the drawing target surface of the drawing target the surface of the nail T) from the ink ejection surface 411 (ink ejection ports of the ink ejection surface 411). The drawing head 41 is not limited to the one which ejects the inks of the above three colors. The drawing head 41 may have an ink cartridge(s) which stores another ink and ink ejection ports therefor.

FIG. 3 is a plan view showing configuration of the base upper surface 20 by removing the X-direction movement stage 45 and the drawing head 41 supported by the head carriage 42 of the drawing mechanism 40.

As shown in FIG. 2 and FIG. 3, on the front portion of the base upper surface 20, approximately at the center in the right-left direction, the finger holder 3 is arranged as described above. In this embodiment, the region corresponding to the window part 33 of the finger holder 3 is the drawing region 21 where the drawing head 41 performs a drawing operation during a drawing period.

Further, the right back portion of the base upper surface 20 forms a standby region 22 where the drawing head 41 is positioned during a no-drawing period.

The standby region 22 is a home position of the drawing head 41, and arranged at a position different from the drawing region 21. The arrangement of the standby region 22 is not limited to that shown in FIG. 3, etc. as long as the standby region 22 is arranged in the area where the drawing head 41 can be moved by the head moving mechanism 49.

The standby region 22 is provided with a cap 23 which covers the ink ejection surface 411.

The cap 23 protects the ink ejection surface 411 during the no-drawing period from drying or the like, and is formed of, for example, flexible resin.

The cap 23 is energized forward by an energizing member 231 having a spring or the like when being at an initial position at which the cap 23 does not to cover the drawing head 41 (e.g., in a state shown in FIG. 3). In this state, the upper surface of the cap 23 is low enough not to contact the lower surface (i.e., the ink ejection surface 411) of the drawing head 41, so that during the drawing period, the cap 23 does not contact the drawing head 41 or prevent the drawing head 41 from moving.

When the drawing head 41 moves to the standby region 22 by moving from the front side to the back side, the drawing head 41 and the head carriage 42, which supports the drawing head 41, push the cap 23 backward against the energizing force of the energizing member 231.

Thus the cap 23 climbs up to the position at which the cap 23 covers the ink ejection surface 411 of the drawing head 41, by being guided by a not-shown rail(s) or the like, so that the ink ejection surface 411 is capped with the cap 23. When the drawing head 41 leaves the standby region 22, the cap 23 is pushed to return to the initial position by the energizing member 231 and thereby descends to the height position again at which the cap 23 does not interfere with the drawing head 41.

The configuration which makes the cap 23 vertically movable between the height position at which the cap 23 does not interfere with the drawing head 41 and the height position at which the cap 23 covers the ink ejection surface 411 of the drawing head 41 is not limited to that described herein.

As shown in FIG. 2 and FIG. 3, on the left back portion of the base upper surface 20, a plurality of maintenance units which perform maintenance of the drawing head 41 is arranged.

In this embodiment, the maintenance units perform different types of maintenance. More specifically, a purging unit 6 to perform a purging process and a wiping unit 7 which wipes the ink ejection surface 411 are provided.

The maintenance units (purging unit 6 and wiping unit 7) are arranged at a position(s) which is different from both the drawing region 21 and the standby region 22 and in the area where the drawing head 41 can be moved by the head moving mechanism 49.

The maintenance units (purging unit 6 and wiping unit 7) are arranged at positions different from each other at least in one of the X direction and the Y direction. In this embodiment, the purging unit 6 and the wiping unit 7 are approximately at the same position in the X-direction, but the purging unit 6 is arranged in front of the wiping unit 7 in the Y direction.

Specific arrangement of the purging unit 6 and the wiping unit 7 is not limited to that shown in FIG. 2, FIG. 3, etc. For example, the positions in the Y direction of the purging unit 6 and the wiping unit 7 may be reversed, or the purging unit 6 and the wiping unit 7 may be arranged at positions different from each other not in the Y direction but in the X direction, or both in the X direction and in the Y direction. Further, at least one of the purging unit 6 and the wiping unit 7 needs to be provided.

The purging unit 6 is a maintenance unit which receives ink forcibly ejected from the ink ejection surface 411 in the purging process. The purging process is a process of forcibly ejecting ink from the ink ejection ports of the ink ejection surface 411, thereby, together with the ink, ejecting air, impurities, viscosity-increased ink and so forth in ink flow passages, such as in nozzles, to the outside.

The purging process, for example, unclogs the nozzles of the drawing head 41, so that the drawing head 41 can recover its excellent ink ejection state.

Further, the purging unit 6 serves as a suspension region where the drawing head 41 can stop temporarily, and is arranged at the position different from both the drawing region 21 and the standby region 22.

Figure 4:
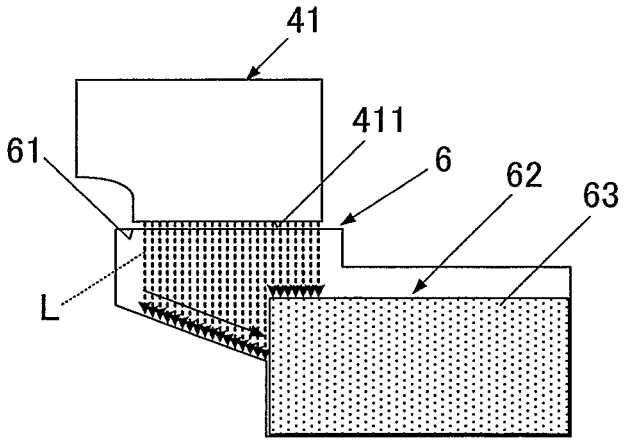
FIG. 4 is a lateral view schematically showing configuration of a purging unit according to the embodiment.

FIG. 4 is a lateral view schematically showing how maintenance of the drawing head 41 is performed in the purging unit 6. In FIG. 4, for the purpose of illustration, the purging unit 6 is shown as if it is a see-though unit. In FIG. 4, ink droplets L ejected by the purging process are indicated by broken lines.

As shown in FIG. 4, the purging unit 6 includes an opening part 61 formed to be somewhat larger than the ink ejection surface 411, and a waste ink tank 62 formed to be continuous with the opening part 61. In the waste ink tank 62, an ink absorber 63 which absorbs ink is arranged. The ink absorber 63 can be formed of any material as long as it can absorb ink quickly. Examples thereof include a porous felt, and a spongy resin.

In this embodiment, from the opening part 61 to the waste ink tank 62, a slope is formed, and the ink ejected from the ink ejection surface 411 of the drawing head 41 flows into the waste ink tank 62 along the slope indicated by an arrow in FIG. 4.

The ink absorber 63 or the whole purging unit 6 may be a component which can be removed and replaced by another one.

The wiping unit 7 is a maintenance unit which wipes and thereby cleans the ink ejection surface 411, and in which a plurality of wiping members 71 is vertically arranged as shown in FIG. 2 and FIG. 3. In this embodiment, four wiping members 71 are arranged in a houndstooth check, thereby being arranged at different positions. The arrangement, size, number and so forth of the wiping members 71 to be provided are not limited to those shown in FIG. 2, FIG. 3, etc.

Each wiping member 71 is a cleaning blade which wipes ink and so forth adhered to the ink ejection surface 411, and formed of, for example, an elastic substance, such as gum. Preferably, the wiping members 71 are formed of a corrosive-resistant material which hardly corrodes or the like even if it repeatedly touches ink.

The wiping member(s) 71 or the whole wiping unit 7 may be a component(s) which can be removed and replaced by another one.

Figure 5:
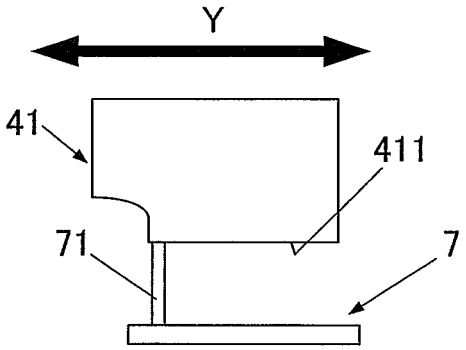
FIG. 5 is a schematic lateral view to explain operation of a wiping unit according to the embodiment.

FIG. 5 is a lateral view schematically showing how the wiping member(s) 71 wipes the ink ejection surface 411 of the drawing head 41.

As shown in FIG. 5, in the case where the Y direction is the moving direction of the drawing head 41, each wiping member 71 is a plate-like member flattened in the X direction which intersects at right angles to the Y direction, and is formed at a position and with a height at and with which the head (upper end) of the wiping member 71 contacts the ink ejection surface 411 when the drawing head 41 passes over the wiping unit 7.

The wiping members 71 flexibly warp as the drawing head 41 moves, and can remove the ink and so forth adhered to the ink ejection surface 411 by slidingly contacting the ink ejection surface 411 with their heads.

When the wiping members 71 wipe the ink ejection surface 411 of the drawing head 41, the ink adheres to the heads and so forth of the wiping members 71.

Hence, in this embodiment, as shown in FIG. 2 and FIG. 3, a scraping unit 70 which removes the ink adhered to the wiping members 71 is arranged behind the wiping unit 7.

The scraping unit 70 is movable in the Y direction along two guide rails 76 extending in the Y direction.

At the front end of the scraping unit 70, a scraping member 74 is arranged. The scraping member 74 scrapes the ink off the heads and so forth of the wiping members 71 by slidingly contacting the wiping members 71. Material, shape and so forth of the scraping member 74 are not particularly limited as long as the scraping member 74 can remove the ink adhered to the wiping members 71.

On the upper surface of the scraping unit 70, a thin plate-like coupling spring 77 which has a mountain-folded bent part at the front end is arranged. The bent part at the front end of the coupling spring 77 is fitted into a not-shown concave part arranged on the lower surface of the head carriage 42, so that the scraping unit 70 is coupled to the head carriage 42 in a disengageable manner.

That is, by moving the head carriage 42 along the Y direction to above the scraping unit 70, the bent part of the coupling spring 77 is fitted into the concave part of the head carriage 42, so that the scraping unit 70 and the head carriage 42 are coupled to each other. By moving the head carriage 42 in this coupled state, the scraping unit 70 can be moved to the position at which the scraping unit 70 can scrape the wiping members 71.

When the scraping unit 70 passes over the wiping members 71 from behind, the scraping unit 70 hits the purging unit 6, so that the bent part of the coupling spring 77 drops (i.e., is disengaged) from the concave part of the head carriage 42. Thus the scraping unit 70 and the head carriage 42 are decoupled from each other. The scraping unit 70 is energized backward by a not-shown energizing spring, and hence when decoupled from the head carriage 42, sent back to its initial position (position in FIG. 3, in this embodiment) by the energizing force of the energizing spring.

Figure 6:
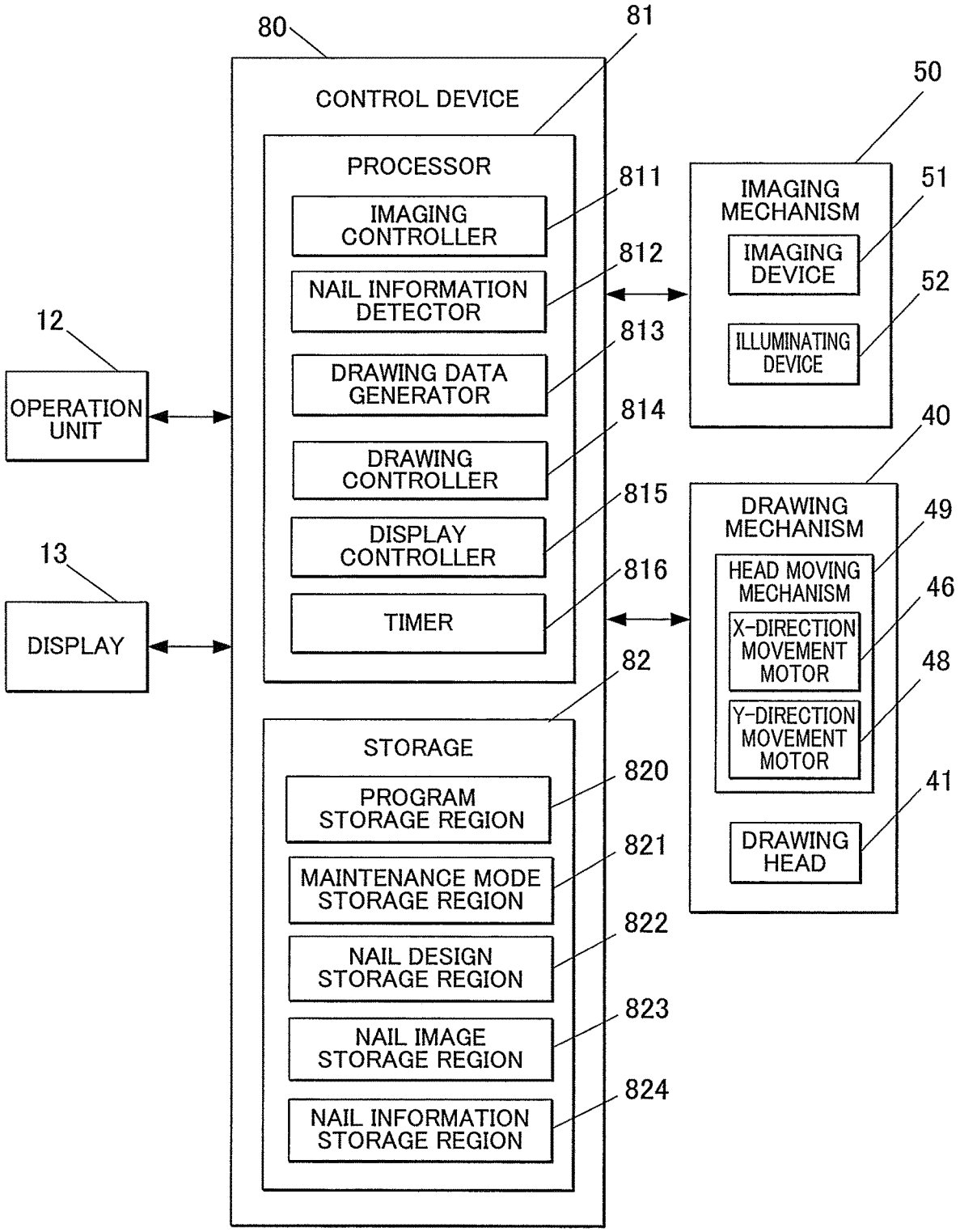
FIG. 6 is a control block diagram showing control configuration of the nail printer according to the embodiment.

FIG. 6 is a control block diagram showing control configuration of the nail printer 1.

As shown in FIG. 6, the nail printer 1 includes the imaging mechanism 50 and the control device 80 in addition to the operation unit 12, the display 13, and the drawing mechanism 40 described above.

The imaging mechanism 50 images nails T, thereby obtaining nail images, which is images of fingers including the nails T, and accordingly functions as an imaging unit and an image obtaining unit.

The imaging mechanism 50 includes an imaging device 51 and an illuminating device 52.

The imaging device 51 is, for example, a small-sized camera which has about two million pixels or more and includes a state image sensor and a lens.

The illuminating device 52 is an illuminating lamp, such as a white LED. In this embodiment, a plurality of illuminating devices 52 is arranged so as to surround the imaging device 51. The number and arrangement of the illuminating devices 52 are not particularly limited.

The imaging mechanism 50 is connected to an imaging controller 811 of the control device 80 described below, and its operation is controlled by the imaging controller 811.

Data of the images obtained by the imaging mechanism 50 are stored in a nail image storage region 823 described below, or the like.

The control device 80 is installed on a not-shown control board or the like arranged on the lower surface side of the upper surface of the case 11, for example. In this embodiment, as described above, in addition to the main control board arranged on the lower surface side of the upper surface of the case 11, control board(s) are dispersedly arranged in/on the X-direction movement stage 45, the head carriage 42 and so forth, and these are electrically connected to one another, so that the components of the nail printer 1 are collectively controlled, and operate in liaison with one another.

More specifically, the control device 80 is a computer including: the processor 81 constituted of a not-shown central processing unit (CPU); and a storage 82 constituted of a not-shown read only memory (ROM) and a not-shown random access memory (RAM), for example.

The storage 82 stores various programs, various data and so forth for causing the nail printer 1 to operate.

More specifically, of the storage 82, in a program storage region 820 constituted of the ROM or the like, various programs are stored. Examples thereof include: a maintenance program to perform maintenance operations to perform maintenance of the drawing head 41; a nail information detection program to detect various types of nail information from each nail image, such as the shape of the nail T, the contour of the nail T, the width of the nail T, and the area of the nail T; a drawing data generation program to generate data for drawing (hereinafter "drawing data"); and a drawing program to perform drawing processes. The control device 80 executes these programs, thereby controlling the components of the nail printer 1 collectively.

In this embodiment, the storage 82 also has: a maintenance mode storage region 821 where data and so forth on a maintenance mode are stored; a nail design storage region 822 where image data on nail designs to be drawn on the nails T are stored; the nail image storage region 823 where the nail images of the nails T of the fingers of the user obtained by the imaging mechanism 50 are stored; a nail information storage region 824 where the nail information (contour of the nail(s) T, angle of inclination (degree of curving) of the nail(s) T, etc.) detected by a nail information detector 812 described below is stored; and so forth.

The processor 81 functionally includes the imaging controller 811, the nail information detector 812, a drawing data generator 813, the drawing controller 814, and a display controller 815. Functions as the imaging controller 811, the nail information detector 812, the drawing data generator 813, the drawing controller 814, the display controller 815 and so forth are realized by the CPU of the processor 81 in cooperation with the programs stored in the program storage region 820 of the storage 82.

In this embodiment, the processor 81 includes a timer 816, and accordingly can grasp various types of elapsed time and so forth.

The imaging controller 811 controls the imaging device 51 and the illuminating devices 52 of the imaging mechanism 50 to cause the imaging device 51 to obtain a finger image (nail image) including an image of a nail T of a finger fixed on the finger holder 3.

Image data of the nail image obtained by the imaging mechanism 50 is stored in the nail image storage region 823 of the storage 82.

The nail information detector 812 detects, on the basis of the image of the nail T of the finger fixed on the finger holder 3, the image being obtained by the imaging device 51, the nail information on the nail T of the finger.

Herein, the nail information includes, for example, the contour of the nail T (nail shape, X and Y coordinates of the horizontal position of the nail T, etc.), the height of the nail T (position of the nail T in the vertical direction, which hereinafter may be referred to as "vertical position of the nail T" or simply "position of the nail T"), and the curvature (degree of curving) of the nail T.

The nail information detected by the nail information detector 812 is stored in the nail information storage region 824 of the storage 82.

The drawing data generator 813 generates, on the basis of the nail information detected by the nail information detector 812, drawing data to be drawn on the nail T of the finger by the drawing head 41.

More specifically, the drawing data generator 813 performs a fitting process of fitting image data on a nail design to the shape of the nail T, for example, by enlarging, reducing or cutting out the image data on the nail design on the basis of the shape or the like of the nail T detected by the nail information detector 812.

If the nail information detector 812 has obtained the curvature or the like of the nail T, the drawing data generator 813 performs, as needed, curved-surface correction to generate drawing data to be drawn on the surface of the nail T as the drawing target surface.

The drawing controller 814 outputs, on the basis of the drawing data generated by the drawing data generator 813, control signals to the drawing mechanism 40 to control operations of the X-direction movement motor 46, the Y-direction movement motor 48, the drawing head 41 and so forth of the drawing mechanism 40 such that drawing on the nail T is performed in accordance with the drawing data.

The display controller 815 controls the display 13 to display various display screens thereon. In this embodiment, the display controller 815 causes the display 13 to display, for example, a nail design selection screen, a thumbnail image for design check, a nail image obtained by imaging a finger including a nail T, an image of an original image being projected to the nail T, various instruction screens, operation screens, and so forth.

Next, a printing method (drawing method) in a case where one nail T is subjected to nail printing will be described.

To perform nail printing with the nail printer 1, first, the control device 80 selects execution of nail printing on one nail T only, and also selects a nail design, on the basis of user operations. Then, the control device 80 instructs the user to set the nail T, which is the drawing target, on the finger holder 3.

When the nail T is set, the control device 80 causes the imaging mechanism 50 to image the nail T, thereby obtaining a nail image, and detects the nail information, such as the contour and the curvature of the nail T, from the nail image. Then, the control device 80 reads data of a drawing image of the nail design, and corrects the data of the drawing image on the basis of the detected nail information on the nail T, thereby generating drawing data.

Next, the control device 80 starts a drawing process on the nail T.

Hereinafter, a drawing process on one nail T only will be described in detail with reference to FIG. 7, FIG. 8A and FIG. 8B.

Figure 7:
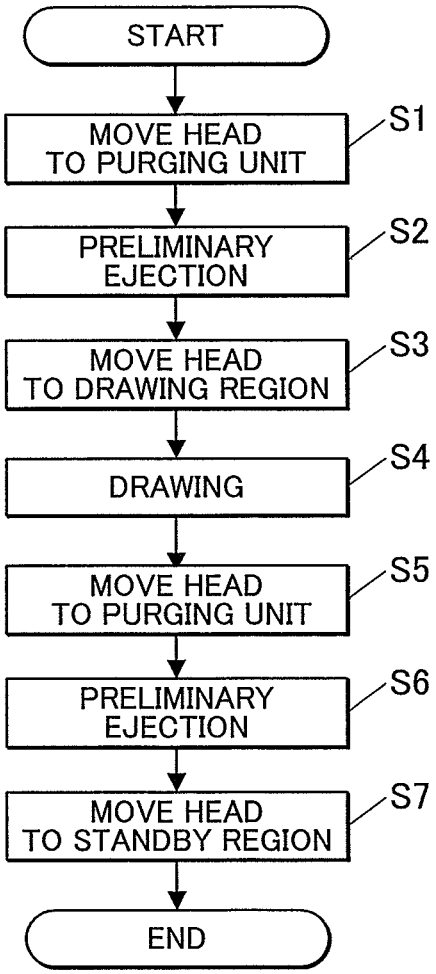
FIG. 7 is a flowchart showing flow of a drawing process in a case where one nail is subjected to nail printing.

FIG. 7 is a flowchart showing flow of the drawing process in the case where one nail T is subjected to nail printing. FIG. 8A and FIG. 8B show a movement locus of the drawing head 41 in this drawing process.

Figure 8A:
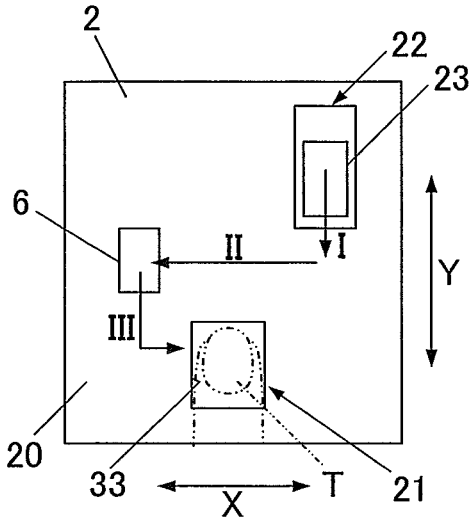
FIG. 8A and FIG. 8B show a movement locus of a drawing head (print head) in the drawing process shown in FIG. 7.

In FIG. 8A and FIG. B, "I" to "III" indicate a route which the drawing head 41 follows.

In order that the drawing head 41 in the standby region 22 moves to the drawing region 21 and performs a drawing operation, as shown in FIG. 7 and FIG. 8A, the drawing controller 814 causes the drawing head 41 which is capped with the cap 23 in the standby region 22 to move forward in the Y direction and leftward in the X direction to the purging unit 6 (Step S1).

Then, the drawing controller 814 causes the drawing head 41 to forcibly eject ink into the purging unit 6 (preliminary ejection) (Step S2). This purging process, for example, unclogs the nozzles of the drawing head 41, the clogging being caused by the drawing operation performs last time.

Next, the drawing controller 814 causes the drawing head 41 to move forward in the Y direction and rightward in the X direction to a drawing start position which is over the drawing region 21 (Step S3), and thereafter outputs the drawing data generated in advance to the drawing mechanism 40, so that the drawing mechanism 40 (drawing head 41) performs drawing on the nail T (Step S4).

Figure 8B:
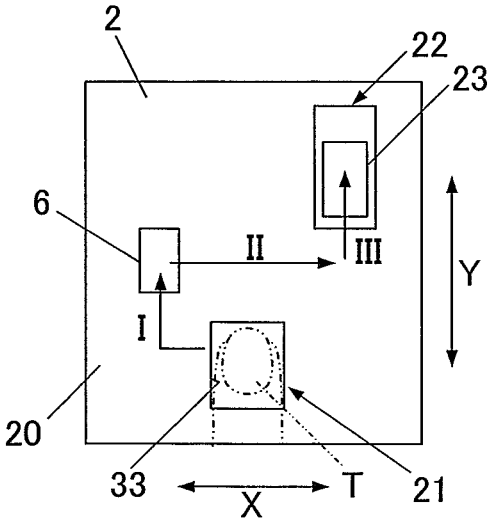

When the drawing mechanism 40 (drawing head 41) finishes the drawing, as shown in FIG. 7 and FIG. 8B, the drawing controller 814 causes the drawing head 41 to move leftward in the X direction and backward in the Y direction to the purging unit 6 (Step S5), and thereafter causes the drawing head 41 to forcibly eject ink into the purging unit 6 (preliminary ejection) (Step S6). This purging process, for example, unclogs the nozzles of the drawing head 41, the clogging being caused by the drawing operation performed in Step S4.

Then, the drawing controller 814 causes the drawing head 41 to move rightward in the X direction and backward in the Y direction to the standby region 22, and the ink ejection surface 411 of the drawing head 41 is covered with the cap 23 in the standby region 22 (Step S7). Then, the control device 80 ends the drawing process.

When ending the drawing process, the control device 80 may cause the display 13 or the like to display a message thereof.

When the control device 80 ends the drawing process, the user removes his/her finger from the nail printer 1, and performs an after-treatment(s), such as drying of the nail T subjected to the drawing, and/or application of an overcoating agent thereto.

Thus, in the case where only one nail T is subjected to the drawing, the drawing head 41 moves by following a route of "standby region 22→purging unit 6→drawing region 21" before drawing, and moves by following the reversed route, namely, a route of "drawing region 21→purging unit 6→standby region 22" after drawing.

Next, a printing method (drawing method) in a successive drawing mode in which nails T are successively subjected to nail printing will be described.

In the case where nails T (e.g., ten nails T) are separately and successively subjected to the drawing in the drawing region 21, first, the control device 80 selects execution of nail printing on a plurality of nails T, and also selects nail design(s) for all the nails T, on the basis of user operations. Then, the control device 80 instructs the user to set the first nail T, which is subjected to the drawing first, on the finger holder 3.

When the nail T is set, the control device 80 causes the imaging mechanism 50 to image the nail T, thereby obtaining a nail image, and detects the nail information, such as the contour and the curvature of the nail T, from the nail image. Then, the control device 80 reads data of a drawing image of the nail design for the nail T, and corrects the data of the drawing image on the basis of the detected nail information on the nail T, thereby generating drawing data.

Next, the control device 80 starts a drawing process.

Hereinafter, a drawing process in the successive drawing mode in which nails T are successively subjected to the drawing will be described in detail with reference to FIG. 9 and FIG. 10A to FIG. 10D.

Figure 9:
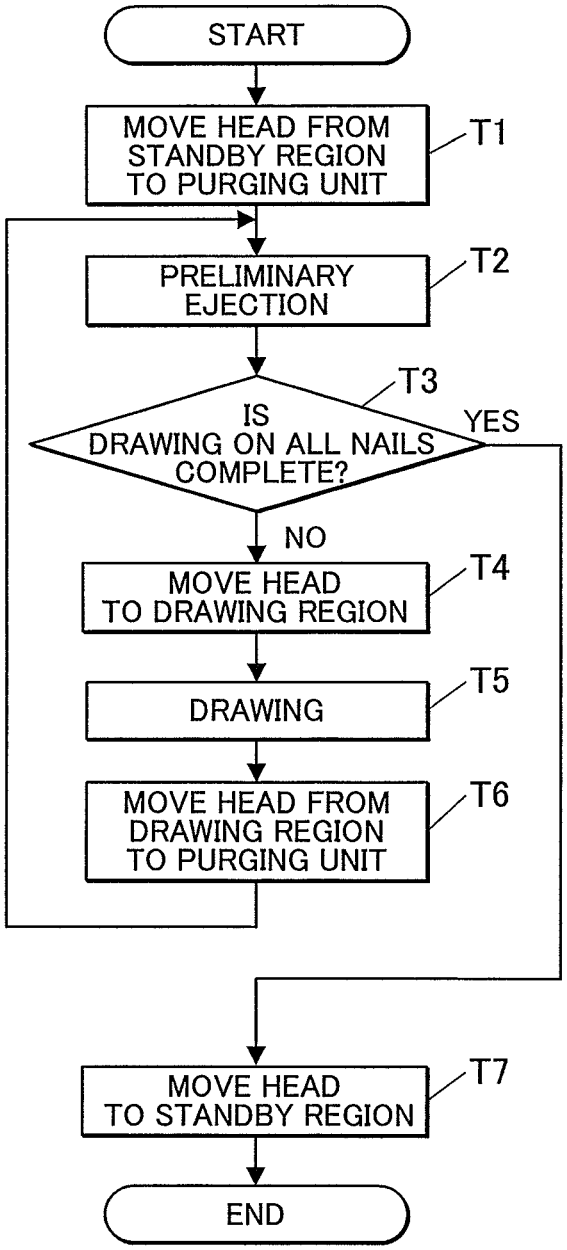
FIG. 9 is a flowchart showing flow of a drawing process in a case where nails are successively subjected to nail printing.

FIG. 9 is a flowchart showing flow of the drawing process in the case where nails T are successively subjected to nail printing. FIG. 10A to FIG. 10D show a movement locus of the drawing head 41 in this drawing process.

Figure 10A:
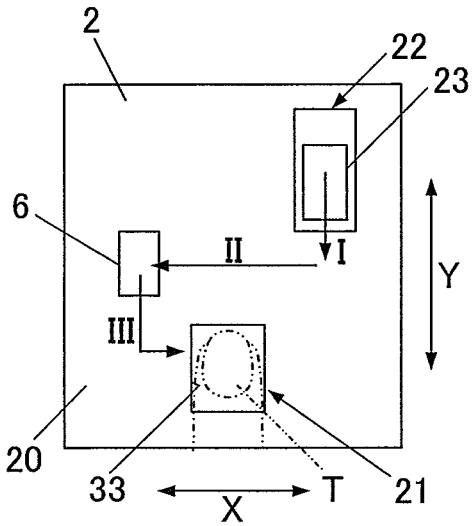
FIG. 10A to FIG. 10D show a movement locus of the drawing head in the drawing process shown in FIG. 9.

In FIG. 10A, "I" to "III" indicate a route which the drawing head 41 follows.

In order that the drawing head 41 in the standby region 22 moves to the drawing region 21 and performs a drawing operation, as shown in FIG. 9 and FIG. 10A, the drawing controller 814 causes the drawing head 41 which is capped with the cap 23 in the standby region 22 to move forward in the Y direction and leftward in the X direction to the purging unit 6 (Step T1).

Then, the drawing controller 814 causes the drawing head 41 to forcibly eject ink into the purging unit 6 (preliminary ejection) (Step T2). This purging process, for example, unclogs the nozzles of the drawing head 41, the clogging being caused by the drawing operation performed immediately before.

Next, the drawing controller 814 determines whether or not drawing on all the nails T is complete (Step T3). When determining that drawing on all the nails T is uncomplete (Step T3; NO), the drawing controller 814 causes the drawing head 41 to move forward in the Y direction and rightward in the X direction to the drawing start position, which is over the drawing region 21 (Step T4).

Then, the drawing controller 814 outputs the drawing data generated in advance to the drawing mechanism 40, so that the drawing mechanism 40 (drawing head 41) performs drawing on the nail T (Step T5).

Figure 10B:
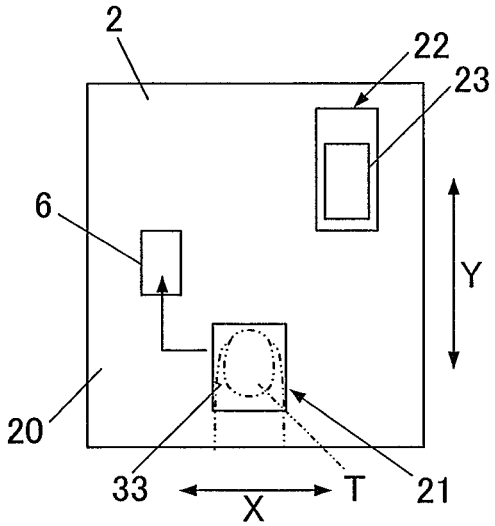

When the drawing mechanism 40 (drawing head 41) finishes the drawing, the drawing controller 814 causes the drawing head 41 to move leftward in the X direction and backward in the Y direction to the purging unit 6 (Step T6; FIG. 10B), and thereafter advances the process to Step T2 described above.

That is, the drawing controller 814 causes the drawing head 41 to forcibly eject ink into the purging unit 6 (preliminary ejection) (Step T2), thereby, for example, unclogging the nozzles of the drawing head 41, the clogging being caused by the drawing operation in Step T5 taken immediately before. If, at this point of time, determining that drawing on all the nails T is uncomplete (Step T3; NO), the control device 80 causes the drawing head 41 to stop temporarily in the purging unit 6 until receiving a drawing execution instruction for the next nail T input on the basis of an user operation or the like.

Figure 10C:
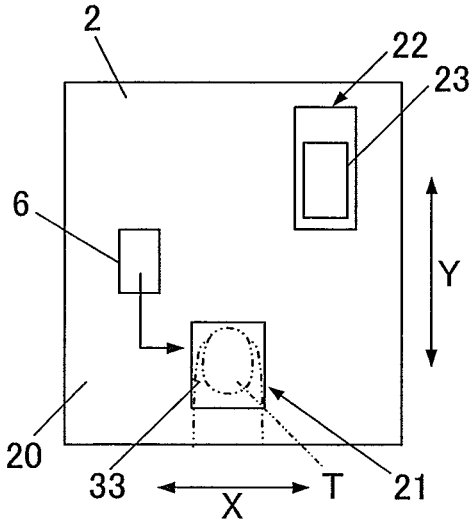
Figure 10D:
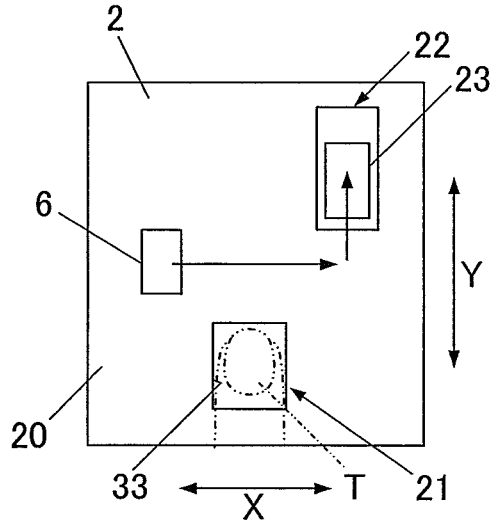

Thereafter, when the next nail T, which is subjected to the drawing next, is set on the finger holder 3, and the control device 80 generates drawing data for this nail T and receives a drawing execution instruction for the nail T, the drawing controller 814 causes the drawing head 41 to move to the drawing region 21 (Step T4; FIG. 10C), and outputs the drawing data to the drawing mechanism 40, so that the drawing mechanism 40 (drawing head 41) performs drawing on the nail T (Step T5). When the drawing mechanism 40 (drawing head 41) finishes the drawing, the drawing controller 814 again causes the drawing head 41 to move to the purging unit 6 (Step T6).

Thus the drawing head 41 performs drawing while nails T are set in the drawing region 21 in order, and each time the drawing head 41 finishes drawing on one nail T, the drawing head 41 is subjected to the purging process.

This series of steps is repeated until it is determined in Step T3 that drawing on all the nails T is complete.

When determining in Step T3 that drawing on all the nails T is complete (Step T3; YES), the drawing controller 814 causes the drawing head 41 to move rightward in the X direction and backward in the Y direction to the standby region 22, and the ink ejection surface 411 of the drawing head 41 is covered with the cap 23 in the standby region 22 (Step T7, FIG. 10D). Then, the control device 80 ends the drawing process.

When ending the drawing process, the control device 80 may cause the display 13 or the like to display a message thereof.

When the control device 80 ends the drawing process, the user removes his/her finger from the nail printer 1, and performs an after-treatment(s), such as drying of the nails T subjected to the drawing, and/or application of an overcoating agent thereto.

Thus, in the case where nails T are successively subjected to the drawing, unlike the above-described case where only one nail T is subjected to the drawing, the drawing head 41 is not sent back to the standby region 22 until drawing on all the nails T is complete, but is stopped temporarily in the purging unit 6 between drawing operations in the drawing region 21.

This can reduce the overall drawing time as compared with the case where the drawing head 41 is sent back to the standby region 22 via the purging unit 6 each time the drawing head 41 finishes a drawing operation in the drawing region 21.

While the drawing head 41 stops temporarily in the purging unit 6, elapsed time from the start of this temporary stop (suspension period) may be measured by the timer 816, and operation of the drawing head 41 may be changed according to the suspension period.

For example, each time the suspension period exceeds a predetermined first period (e.g., one minute) which generates a risk of ink getting dry, the purging process may be performed to prevent ink from drying. This can properly prevent the ink ejection surface 411 and the nozzles from drying.

Alternatively or additionally, when the suspension period exceeds a second period (e.g., five minutes) which is longer than the first period, the drawing head 41 may be sent back to the standby region 22 on the assumption that the next drawing execution instruction is no longer made. This can properly prevent the ink ejection surface 411 and the nozzles from drying, even when, for example, the user has moved on to another work and abandoned the drawing on the nails T.

Instead of or in addition to the purging process in the purging unit 6, the wiping process in the wiping unit 7 and/or another maintenance process to keep the ink ejection state of the drawing head 41 normal may be performed.

As described above, according to this embodiment, if nails Tare separately and successively subjected to the drawing in the drawing region 21, between drawing operations in the drawing region 21, the drawing head 41 is not moved to the standby region 22, but is stopped temporarily in the purging unit 6.

This can reduce the overall drawing time as compared with the case where each time the drawing head 41 finishes a drawing operation in the drawing region 21, the drawing head 41 is sent back to the standby region 22 after subjected to the purging process in the purging unit 6. In the successive drawing mode, the no-drawing period, which is between drawing operations, is devoted to a change of a nail T to another and drawing data generation, and hence not much time is required, essentially. If the drawing head 41 was sent back to the standby region 22 during the no-drawing period, extra time would be required. According to this embodiment, the extra time, which would be required for the above movement of the drawing head 41, can be eliminated.

Hence, in the case where nails T are separately and successively subjected to the drawing in the drawing region 21, the drawing time can be shorter than ever before.

Further, in this embodiment, each time the drawing head 41 stops temporarily in the purging unit 6, the purging process is performed in the purging unit 6. This can keep the ink ejection state of the drawing head 41 always excellent.

Further, in this embodiment, the standby region 22 is provided with the cap 23 which covers the ink ejection surface 411. This can properly prevent the ink ejection surface 411 and the nozzles from drying in the standby region 22.

In the above, the embodiment(s) of the present invention has been described. Needless to say, however, the present invention is not limited to the embodiments, and can be modified in a variety of respects without departing from the scope of the present invention.

For example, in the embodiment, the purging unit 6 is the one into which ink is forcibly ejected in the same manner as normal ink ejection. However, configuration of the purging unit is not limited thereto.

For example, there may be provided a purging unit which includes a small-sized pump, and employs a method of sucking ink, impurities and so forth remaining, for example, in the nozzles with the pump in a state in which the ink ejection surface 411 is covered up tight, and forcibly ejecting these to the outside.

Further, in the embodiment, as one of the maintenance units, the purging unit 6 is provided. However, types of the maintenance units are not limited thereto. Instead of the purging unit 6, another maintenance unit may be provided.

As another maintenance unit, there may be provided a unit which absorbs and thereby removes the ink and so forth adhered to the ink ejection surface 411 by pressing an absorbing member formed of a high-absorbent material, such as a felt, to the ink ejection surface 411.

Further, in the embodiment, one purging unit 6 and one wiping unit 7 are provided. However, the number of the purging units 6 and the number of the wiping units 7 to be provided are not particularly limited, and one type of maintenance units may be provided at multiple positions. For example, the purging units 6 may be arranged near the standby region 22 and near the drawing region 21, or the wiping units 7 may be arranged in front of, behind, and/or lateral to the purging unit(s) 6. If two or more purging units 6 are provided, it is preferable that the purging unit 6 where the drawing head 41 stops temporarily be the one which is arranged closer (or the closest) to the drawing region 21.

Further, in the embodiment, the drawing head 41 stops temporarily in the purging unit 6. Alternatively, a suspension region exclusive to the temporary stop of the drawing head 41 may be provided, and the drawing head 41 may stop temporarily in this suspension region.

In this case, the suspension region should be provided with an ink saucer which receives ink dropped from the drawing head 41.

Further, in this case, preferably, distance (moving distance of the drawing head 41) from the suspension region to the drawing region 21 is shorter than distance (moving distance of the drawing head 41) from the standby region 22 to the drawing region 21. This can further reduce the time required for the movement of the drawing head 41 between drawing operations in the successive drawing mode. The same applies to this embodiment, where the purging unit 6 serves as the suspension region.

Further, in the embodiment, in the case where nails T are successively subjected to the drawing, nail design(s) for all the nails T are selected when the drawing process is about to start. Alternatively, each time drawing on one nail T finishes, a nail design for the next nail T, which is subjected to the drawing next, may be selected.

Further, in the embodiment, the user operates the operation unit 12 to make various inputs. Alternatively, the user may make various inputs, using, for example, a dedicated application program to cause the nail printer 1 to operate, installed in a smartphone or a tablet. In this case, as a matter of course, the nail printer 1 needs to be configured to be communicable with smartphones or tablets.

Further, in the embodiment, the nail T of the finger fixed on the finger holder 3 is imaged and subjected to the drawing. However, the target which can be subjected to the drawing in the nail printer 1 (printer) is not limited to nails T of fingers.

For example, nail-shaped products or the like, such as nail tips which are used by being attached to the nails T, can be the "nails" which can be subjected to the drawing in the printer of the present invention.

In the above, one or more embodiments of the present invention have been described. However, the scope of the present invention is not limited thereto, and includes the scope of claims below and the scope of their equivalents.

What is claimed is:

1. A printer comprising:

a print head; and a processor which controls operation of the print head, wherein wherein an area where the print head is movable includes (i) a drawing region where a finger or a toe is placed and the print head performs drawing on a nail of the finger or the toe, (ii) a standby region where the print head is positioned during a no-drawing period in which the print head does not perform the drawing, and (iii) a suspension region where the print head can stop temporarily, a moving distance of the print head from the suspension region to the drawing region being shorter than a moving distance of the print head from the standby region to the drawing region, and wherein, when one nail is subjected to the drawing and successively a next nail is subjected to the drawing, the one nail and the next nail being nails among two or more nails to be successively subjected to the drawing, the processor causes the print head to stop temporarily in the suspension region between drawing operations on the one nail and the next nail without causing the print head to move to the standby region.

2. The printer according to claim 1, further comprising at least one maintenance unit which is provided in the suspension region and which performs maintenance of the print head.

3. The printer according to claim 2, wherein the maintenance unit includes at least one of a purging unit which receives an ink forcibly ejected from an ink ejection surface of the print head and a wiping unit which wipes the ink ejection surface of the print head.

4. The printer according to claim 2, wherein the processor obtains a suspension period which is a time elapsed from a start of the temporary stop of the print head in the suspension region, and causes the maintenance unit to perform the maintenance of the print head each time the obtained suspension period exceeds a first period.

5. The printer according to claim 4, wherein the processor causes the print head to move to the standby region when the obtained suspension period exceeds a second period which is longer than the first period.

6. The printer according to claim 1, further comprising a cap which is provided in the standby region and which covers an ink ejection surface of the print head.

7. A printing method for a printer including a print head, an area of the printer where the print head is movable including (i) a drawing region where a finger or a toe is placed and the print head performs drawing on a nail of the finger or the toe, (ii) a standby region where the print head is positioned during a no-drawing period in which the print head does not perform the drawing, and (iii) a suspension region where the print head can stop temporarily, a moving distance of the print head from the suspension region to the drawing region being shorter than a moving distance of the print head from the standby region to the drawing region, and the printing method comprising:

when one nail is subjected to the drawing and successively a next nail is subjected to the drawing, the one nail and the next nail being nails among two or more nails to be successively subjected to the drawing, causing the print head to stop temporarily in the suspension region between drawing operations on the one nail and the next nail without causing the print head to move to the standby region.

8. A non-transitory computer readable storage medium storing a program that is executed by a computer which controls a printer including a print head, an area of the printer where the print head is movable including (i) a drawing region where a finger or a toe is placed and the print head performs drawing on a nail of the finger or the toe, (ii) a standby region where the print head is provided during a no-drawing period in which the print head does not perform the drawing, and (iii) a suspension region where the print head can stop temporarily, a moving distance of the print head from the suspension region to the drawing region being shorter than a moving distance of the print head from the standby region to the drawing region, and the program causing the computer to:

when one nail is subjected to the drawing and successively a next nail is subjected to the drawing, the one nail and the next nail being nails among two or more nails to be successively subjected to the drawing, cause the print head to stop temporarily in the suspension region between drawing operations on the one nail and the next nail without causing the print head to move to the standby region.

* * * * *